US006071601A

United States Patent [19]

Oshika et al.

[11] Patent Number: 6,071,601

[45] Date of Patent: Jun. 6, 2000

[54] COATED CUTTING TOOL MEMBER

[75] Inventors: Takatoshi Oshika, Omiya; Kouichi Yuri, Anpachi-gun; Tetsuhiko Honma, Omiya; Eiji Nakamura, Omiya; Atsushi Nagamine, Omiya; Kazuya Yanagida, Omiya, all of Japan

[73] Assignee: Mitsubishi Materials Corporation, Tokyo, Japan

[21] Appl. No.: 09/075,923

[22] Filed: May 12, 1998

[30] Foreign Application Priority Data

| | | | |
|---|---|---|---|
| May 12, 1997 | [JP] | Japan | 9-120704 |
| Sep. 3, 1997 | [JP] | Japan | 9-238198 |
| Nov. 19, 1997 | [JP] | Japan | 9-318100 |

[51] Int. Cl.[7] ..... B32B 9/00; B32B 7/06

[52] U.S. Cl. ..... 428/216; 51/295; 51/307; 51/309; 428/212; 428/336; 428/698; 428/701; 428/702

[58] Field of Search ..... 428/701, 702, 428/698, 216, 212, 336; 51/295, 307, 309

[56] References Cited

U.S. PATENT DOCUMENTS

| | | | |
|---|---|---|---|
| 4,442,169 | 4/1984 | Graham . | |
| 4,463,062 | 7/1984 | Hale . | |
| 4,812,370 | 3/1989 | Okada et al. | 428/552 |
| 5,863,640 | 1/1999 | Ljungberg et al. | 428/216 |
| 5,920,760 | 7/1999 | Yoshimura et al. | 428/551 |

FOREIGN PATENT DOCUMENTS

| | | |
|---|---|---|
| 0 083 842 | 7/1983 | European Pat. Off. . |
| 0 162 656 | 5/1985 | European Pat. Off. . |
| 0 594 875 | 5/1994 | European Pat. Off. . |
| 53-7513 | 1/1978 | Japan . |
| 53-89803 | 8/1978 | Japan . |

OTHER PUBLICATIONS

English Abstract of JP 6–108254 (Apr. 1994).

*Primary Examiner*—Archene Turner
*Attorney, Agent, or Firm*—Oblon, Spivak, McClelland, Maier & Neustadt, P.C.

[57] ABSTRACT

The present invention provide for a cutting tool member that has been coated with a hard coating. The hard coating has multiple layers including: a) a layer made of a titanium compound that has a cubic lattice structure, b) an $Al_2O_3$ layer, and c) an intervening layer that includes a $Ti_2O_3$ compound with a corundum-type lattice structure. The hard coating layer provides the cutting tool member with good strength and increases its operational lifetime.

24 Claims, 1 Drawing Sheet

COATED CUTTING TOOL MEMBER

BACKGROUND OF THE INVENTION

1. Field of the Invention

The present invention relates to a coated cutting tool member that resists chipping and wear for long periods of time during cutting operations.

2. Description of the Related Art

Coated carbide cutting tool members are preferably composed of a tungsten carbide-based cemented carbide substrate and a hard coating layer preferably made of aluminum oxide (hereinafter referred to as "$Al_2O_3$"). Preferably, they further comprise a cubic-type titanium compound layer preferably including at least one layer of titanium compound having a "cubic" crystal structure preferably selected from titanium carbide (TiC), titanium nitride (TiN), titanium carbonitride (TiCN), titanium carboxide (TiCO), titanium nitroxide (TiNO) and titanium carbonitroxide (TiCNO). The hard coating layer is formed preferably by means of chemical vapor deposition and/or physical vapor deposition and have an average thickness of 3 to 20 $\mu$m. X-ray diffraction can confirm that the crystal structure of a titanium compound layer is cubic-type (hereinafter referred to as "cubic-type titanium compound layer"). A coated carbide cutting tool member having a hard coating layer, wherein the first layer is TiN, the second layer is TiCN, the third layer is TiCNO, the fourth layer is $Al_2O_3$ and fifth layer is TiN disclosed in Japanese Unexamined Patent Publication No.7-328810. These coated carbide cutting tool members are widely used in various fields of cutting operations, for example, continuous and interrupted cutting operation of metal work pieces.

It is known that cubic-type titanium compound layers have granular crystal morphology and are used for many applications. Recently, a TiCN layer that has a longitudinal crystal morphology has found use as a highly wear resistant coating layer. TiC layers have been used as highly abrasion resistant materials in many applications. TiN layers have been used in many fields, for example, as an outermost layer of a coated cutting tool member and for various decorative products, because of its beautiful external view like gold. Layers of $Al_2O_3$ have several different crystal polymorphs, among which the alpha-$Al_2O_3$ is known as the thermodynamically most stable polymorph, having a corundum structure. Typically, an $Al_2O_3$ coating formed by CVD has three kinds of $Al_2O_3$ polymorphs, namely, stable alpha-$Al_2O_3$, meta-stable kappa-$Al_2O_3$ and amorphous $Al_2O_3$.

In recent years, there has been an increasing demand for labor-saving, less time consuming cutting operations. These operations preferably include high speed cutting operations such as high speed feeding and/or high speed cutting. In these cutting operations, cutting tools are exposed to extraordinarily severe conditions. During these high speed cutting operations, the temperature of the cutting edge rises to 1000° C., or more and work chips of exceedingly high temperature are in contact with the surface of the rake face of the cutting tool. This phenomenon accelerates the occurrence of crater wear on the rake face. Thus, the cutting tool is chipped or damaged at a relatively early stage.

In order to circumvent this situation, a coated carbide cutting tool which has a relatively thick $Al_2O_3$ layer has been examined and produced. The $Al_2O_3$ layer has favorable properties such as extremely high resistance against oxidation, chemical stability and high hardness which meet the demands of cutting tools that are used under high temperature conditions. However, applying $Al_2O_3$ layers to cutting tools does not work out as one desires. Adhesion strength of the $Al_2O_3$ layer to an adjacent cubic-type titanium compound layer is usually not adequate, especially when the $Al_2O_3$ polymorph is alpha-type, and it is also inevitable that the $Al_2O_3$ layer has local nonuniformity in its thickness when it becomes a thicker layer. The $Al_2O_3$ layer tends to be thicker at the edge portion of the cutting tool, for example, than that at the other portions of the tool. When the thick $Al_2O_3$ layer is applied as a constituent of a hard coating layer, it is likely to show relatively short life time, for example, due to an occurrence of some kind of damage such as chipping, flaking and breakage.

As the cutting speed of various cutting operations continue to increase, thicker coatings of $Al_2O_3$ will be required to protect carbide cutting tools. With thicker $Al_2O_3$ layers, tool-life time will be more sensitive to both the adhesion strength between $Al_2O_3$ layer and cubic-type titanium compound layer as well as the toughness of $Al_2O_3$ layer itself. Methods for adhering $Al_2O_3$ layers to other compound layers and methods for making tough and thick $Al_2O_3$ layers continue to grow in importance with increasing demand for cutting tools that work at higher and higher speeds.

SUMMARY OF THE INVENTION

Accordingly, one object of this invention provides for a coated carbide cutting tool member having a thick $Al_2O_3$ layer that strongly adheres to a cubic-type titanium compound layer and that shows excellent uniformity in $Al_2O_3$ thickness. Another object of the invention provides for coated carbide cutting tool members which have excellent wear resistance and damage resistance.

These and other objects of the present invention have been satisfied by the discovery of a coated carbide cutting tool member whose cemented carbide substrate is coated with hard coating layer preferably comprising a titanium compound layer with a cubic lattice structure, an $Al_2O_3$ layer, and an intervening layer that lies between the titanium compound layer and the $Al_2O_3$ layer. The intervening layer preferably comprises titanium oxide that has a corundum-type lattice structure (hereinafter referred to as "$Ti_2O_3$"). This coated carbide cutting tool member gives good wear resistance and long tool lifetime when used in high speed cutting operations.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
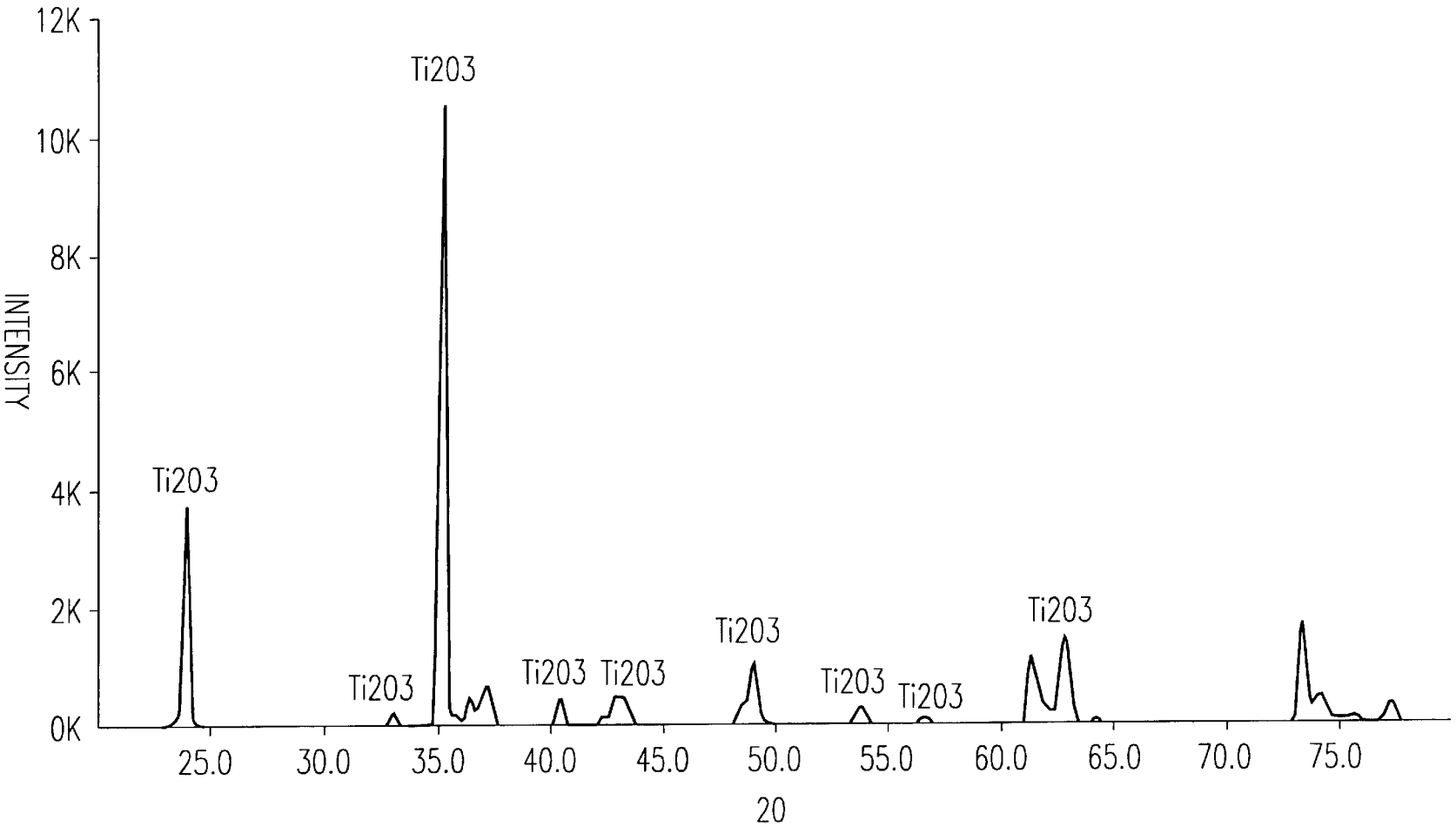
FIG. 1 is a graph showing X-ray diffraction for coated carbide cutting inserts in accordance with the present invention 23 in EXAMPLE 3, before the deposition of $Al_2O_3$ layer.

The present invention provides for a cutting tool having a cutting tool member that is coated with a hard coating layer. A "cutting tool member" refers to the part of the cutting tool that actually cuts the work piece. Cutting tool members include exchangeable cutting inserts to be mounted on face milling cutter bodies, bit shanks of turning tools, and cutting blade of end mills. The cutting tool member is preferably made of tungsten carbide-based cemented carbide substrates.

A hard coating coats preferably a fraction of the surface, more preferably the entire surface of the cutting tool member. The hard coating is preferably made of a titanium compound layer with a cubic lattice structure, an $Al_2O_3$ layer, and an intervening layer that lies between the titanium compound layer and the $Al_2O_3$ layer. The intervening layer may directly contact one or both of the titanium compound layer with a cubic lattice structure and the $Al_2O_3$ layer. Although the $Al_2O_3$ layer is preferably the outermost layer of the hard coating layer, a TiN layer is used as outermost layer in many cases because of its beautiful appearance.

The titanium compound layer with the cubic lattice structure is composed of at least one layer selected from the group consisting of TiC, TiN, TiCN, TiCO, TiNO and TiCNO. The intervening layer preferably comprises titanium oxide that has a corundum-type lattice structure (hereinafter referred to as "$Ti_2O_3$").

The preferred embodiments of the present invention were discovered after testing many different kinds of hard coating layers on coated carbide cutting tool members. In all of these tests, the hard coating layers included at least one titanium compound layer with a cubic lattice structure, at least one $Al_2O_3$ layer, and an intervening layer between the two other layers. From these tests, the following results (A) through (G) were found:

(A) When intervening layer preferably comprising $Ti_2O_3$ was inserted between said cubic-type titanium compound layer and said $Al_2O_3$ layer, the obtained coated carbide cutting tool exhibited longer tool life time.

(B) When intervening layer preferably comprising $Ti_2O_3$ was used, the cutting properties of the obtained cutting tool member varied according to the specific orientation in X-ray diffraction of said intervening layer. X-ray diffraction was performed using Cu k$\alpha$-ray. When an intervening layer preferably comprises $Ti_2O_3$ having an X-ray diffraction pattern showing the maximum peak intensity at $2\theta=53.8\pm1°$ (the same as ASTM10-63), the obtained coated carbide cutting tool member exhibited longer tool life time. Moreover, when intervening layer preferably comprises $Ti_2O_3$ having an X-ray diffraction pattern showing the maximum peak intensity at $2\theta=34.5\pm1°$, the obtained coated carbide cutting tool member exhibited an even longer lifetime.

(C) When an intervening layer preferably comprises $Ti_2O_3$, having an X-ray diffraction pattern showing the maximum peak intensity at $2\theta=34.5\pm1°$, and further comprising a suitable amount of TiCNO, the obtained coated carbide cutting tool member exhibited even longer tool lifetimes in high speed continuous and interrupted cutting operations for steel and cast iron. The presence of TiCNO phase was confirmed by elemental analysis using an EPMA (electron probe micro analyzer) and X-ray diffraction. However, too much TiCNO in the intervening layer was not favorable because the properties of said layer became similar to that of cubic TiCNO layer.

(D) Other titanium oxide layers which can be obtained by chemical vapor deposition process including TiO, $Ti_4O_7$ and $TiO_2$ were also evaluated as intervening layers. The surface of these layers were smooth and dense nucleation of $Al_2O_3$ was obtained for the intervening layers made from these materials just like for $Ti_2O_3$. We thought that these phenomena might be attributed to the high density of oxygen atoms on the surface of said layers. For these layers, the presence of a cubic titanium compound phase was not confirmed. Coated carbide cutting inserts having intervening layers made from TiO, $Ti_4O_7$ and $TiO_2$ exhibited inferior cutting properties compared to the intervening layer comprising mainly $Ti_2O_3$. Flaking of $Al_2O_3$ layer and chipping in quite early stages of cutting operation were frequently observed even in continuous cutting operations of steel and cast iron. For these observations we have found that $Ti_2O_3$ is the most preferred intervening layer between a cubic-type titanium compound layer and an $Al_2O_3$ layer.

(E) Improvement in cutting properties by having an intervening layer comprising mainly $Ti_2O_3$ might be attributed to the higher adhesion strength between this layer and the $Al_2O_3$ layer compared to the adhesion strength between a cubic-type titanium compound layer and an $Al_2O_3$ layer. We interpret the concept of "adhesion strength" as a combination effect of the "chemical bonding" between the two layers which are in contact with each other and the "mechanical bonding" between these two layers. An intervening layer preferably comprising $Ti_2O_3$ may have higher chemical bonding toward an $Al_2O_3$ layer than other cubic-type titanium compound layers and this layer may have more mechanical bonding because its surface is preferably rough. It has been confirmed that the surface morphology of the layer comprising mainly $Ti_2O_3$ is made favorably rougher, by the addition of a suitable amount of TiCNO in said layer. The positive effect of TiCNO in the layer comprising mainly $Ti_2O_3$ may be due to an increasing of mechanical bonding between said layer and the $Al_2O_3$ layer.

(F) The chemical bonding between other titanium oxide intervening layers, TiO, $Ti_4O_7$ and $TiO_2$ and the $Al_2O_3$ layer may also be high. However, the cutting properties of the coated carbide cutting tool member using these titanium oxides was found inadequate. We think that the reason for the relative short tool lifetime in cutting operations for these intervening layers might be attributed to a lack of a sufficient surface roughness. Consequently, the mechanical bonding between the intervening layers and the $Al_2O_3$ layer might have been weak.

(G) When the $Al_2O_3$ layer gets thicker, the tool lifetime of the coated carbide cutting tool member gets shorter. Experiments revealed that the shorter lifetime of the tool was caused by fracturing in the thick $Al_2O_3$ layer. The fracturing was attributed to a brittleness of thicker $Al_2O_3$ layers, especially at the edge of the tool member. This is because the $Al_2O_3$ layer at the edge is generally thicker than that at any other part of the tool, such as flank face or rake face.

In these cases, it is possible to make the thick $Al_2O_3$ layer tougher by replacing the thick $Al_2O_3$ with a composite structure layer preferably comprising at least two $Al_2O_3$ layers and at least one intervening layer preferably comprising mainly $Ti_2O_3$. By this method, the nonuniformity in $Al_2O_3$ layer thickness was improved and consequently tool lifetime of said cutting tool member was improved even for an interrupted cutting operation.

Based on these results, the present invention provides for a coated carbide cutting tool member that exhibits extremely high wear resistance for various cutting operations and that has a long tool lifetime by providing a coated carbide cutting tool member preferably composed of a cemented carbide substrate and a hard coating layer preferably having an average thickness of 3 to 25 $\mu$m formed on said substrate being composed of at least one layer selected from the group of TiC, TiN, TiCN, TiCO, TiNO, TiCNO and $Al_2O_3$, wherein said hard coating layer further has an intervening layer preferably comprising mainly $Ti_2O_3$, having an X-ray diffraction pattern showing the maximum peak intensity at $2\theta=34.5\pm1°$, and formed between said cubic-type titanium compound layer and said $Al_2O_3$ layer. The present invention also provides for a coated carbide cutting tool member with a thick $Al_2O_3$ layer that exhibits extremely high toughness by providing a coated carbide cutting tool member, wherein the $Al_2O_3$ layer is replaced with a composite structure layer preferably comprising at least two $Al_2O_3$ layers and at least one intervening layer preferably comprising mainly $Ti_2O_3$.

In the present invention, the average thickness of the hard coating layer is preferably 3 to 25 $\mu$m. Excellent wear resistance cannot be achieved at a thickness of less than 3 μm, whereas damage and chipping of the cutting tool member easily occur at a thickness of over 25 μm.

The average thickness of the intervening layer is preferably 0.1 to 5 μm. Satisfactory bonding effect toward both cubic-type titanium compound layer and $Al_2O_3$ layer cannot be achieved at a thickness of less than 0.1 μm, whereas the possibility of chipping occurrence of the cutting tool member becomes significant at a thickness of over 5 μm.

The average thickness of the individual $Al_2O_3$ layer in composite structure layer is preferably 0.5 to 12 μm, more preferably 0.5 to 10 μm, still more preferably 0.5 to 7 μm. It becomes difficult to provide satisfactory properties of $Al_2O_3$ such as oxidation resistance, chemical stability and hardness toward said composite structure layer at a thickness of less than 0.5 μm, whereas both the uniformity of layer thickness and toughness of said composite structure layer becomes insufficient at a thickness of over 12 μm.

The average thickness of the individual intervening layer in composite, structure layer is preferably 0.05 to 2 μm. It becomes difficult to keep sufficient toughness of cutting tool member at a thickness of less than 0.05 μm, whereas wear resistance decreases at a thickness of over 2 μm.

The ratio of TiCNO in an intervening layer comprising mainly $Ti_2O_3$ was expressed using ratio of carbon plus nitrogen in said layer as follows:

preferably $0\% \leqq (C+N)/Ti+O+C+N) \leqq 10\%$ more preferably $0.5\% \leqq (C+N)/(Ti+O+C+N) \leqq 5\%$.

The properties of said layer were similar to that of a cubic TiCNO layer when the ratio was over 10%.

The "cubic" lattice structure is defined to include simple cubic lattices, body centered cubic lattices, and face centered cubic lattices, among others.

Further, said layer mainly comprising $Ti_2O_3$ is formed by means of chemical vapor deposition using a reactive gas preferably containing 0.4 to 10 percent by volume (hereinafter merely percent) of $TiCl_4$, 0.4 to 10 percent of carbon dioxide ($CO_2$), 5 to 40 percent of nitrogen ($N_2$), 0 to 40 percent of argon (Ar), and the remaining balance of the reactive gas being hydrogen ($H_2$) at a temperature of 800 to 1100° C. and a pressure of 30 to 500 Torr.

EXAMPLES

Having generally described this invention, a further understanding can be obtained by reference to certain specific examples which are provided herein for purposes of illustration only and are not intended to be limiting unless otherwise specified.

Example 1

The following powders were prepared as raw materials: a WC powder with an average grain size of 2.8 μm; a coarse WC powder with an average grain size of 4.9 μm; a TiC/WC powder with an average grain size of 1.5 μm (TiC/WC=30/70 by weight); a (Ti,W)CN powder with an average grain size of 1.2 μm (TiC/TiN/WC=24/20/56); a TaC/NbC powder with an average grain size of 1.2 μm (TaC/NbC=90/10); and a Co powder with an average grain size of 1.1 μm. These powders were compounded based on the formulation shown in Table 1, wet-mixed in a ball mill for 72 hours, and dried. The dry mixture was pressed to form a green compact for cutting insert defined in ISO-CNMG120408 (for carbide substrates A through D) or ISO-SEEN42AFTN1 (for carbide substrate E), followed by vacuum sintering under the conditions set forth in Table 1 for Carbide substrates A through E. (Note: the contents of ISO-CNMG120408 and ISO-SEEN42AFTN1 are hereby incorporated by reference.)

The carbide substrate B was held in a $CH_4$ atmosphere of 100 Torr at 1400° C. for 1 hour, followed by annealing for carburization. The carburized substrate was then subjected to treatment by acid and barrel finishing to remove carbon and cobalt on the substrate surface. The substrate was covered with a Co-enriched zone having a thickness of 42 μm and a maximum Co content of 15.9 percent by weight at a depth of 11 μm from the surface of the substrate.

Sintered carbide substrates A and D had a Co-enriched zone having a thickness of 23 μm and a maximum Co content of 9.1 percent by weight at a depth of 17 μm from the surface of the substrate. Carbide substrates C and E had no Co-enriched zone and had homogeneous microstructures.

The Rockwell hardness (Scale A) of each of the carbide substrates A through E is also shown in Table 1.

The surface of the carbide substrates A through E were subjected to honing and chemical vapor deposition using conventional equipment under the conditions shown in Table 2 to form hard coating layers that had a composition and a designed thickness (at the flank face of the cutting insert) shown in Tables 3 and 4. TiCN* in each Table represented the TiCN layer that had a crystal morphology longitudinally grown as described in Japanese Unexamined Patent Publication No-6-8010. Coated carbide cutting inserts in accordance with the present invention 1 through 10 and conventional coated carbide cutting inserts 1 through 10 were produced in such a manner.

Further, continuous cutting tests and interrupted cutting tests were conducted for above cutting inserts under the following conditions.

A wear width on a flank face was measured in each tests.

For coated carbide cutting inserts of the present invention I through 9 and conventional coated carbide cutting inserts I through 9, the following cutting tests were conducted:

(1-1) Cutting style: Continuous turning of alloy steel

Work piece: JIS SCM440 round bar

Cutting speed: 350 m/min

Feed rate: 0. 4 mm/rev

Depth of cut: 3 mm

Cutting time: 10 min

Coolant: Dry (1-2) Cutting style: Interrupted turning of alloy steel

Work piece: JIS SNCM439 square bar

Cutting speed: 180 m/min

Feed rate: 0.25 mm/rev

Depth of cut: 3 mm

Cutting time: 5 min

Coolant: Dry

For coated carbide cutting inserts of the present invention 10 and conventional coated carbide cutting inserts 10, following cutting tests were conducted:

(1-3) Cutting style: Milling of carbon steel

Work piece: JIS S45C square bar (100 mm width×500 mm length)

Cutting tool configuration: single cutting insert mounted with a cutter of 125 mm diameter Cutting speed: 200 m/min Feed rate: 0.15 mm/tooth Depth of cut: 2 mm Cutting time: 10 min Coolant: Dry Results are shown in Table 5.

Example 2

The same carbide substrates A through E as in EXAMPLE 1 were prepared. The surfaces of the carbide substrates A through E were subjected to honing and chemical vapor deposition using conventional equipment under the conditions shown in Table 6 to form hard coating layers that had a composition and a designed thickness (at the flank of the cutting insert) shown in Table 7 and 8. Coated carbide cutting inserts in accordance with the present invention 11 through 20 and conventional coated carbide cutting inserts 11 through 20 were produced in such a manner.

Further, continuous cutting tests and interrupted cutting tests were conducted for above cutting inserts under the following conditions. A wear width on a flank face was measured in each test.

For coated carbide cutting inserts of the present invention 11, 12 and conventional coated carbide cutting inserts 11, 12, following cutting tests were conducted:

(2-1) Cutting style: Interrupted turning of Ductile cast iron

Work piece: JIS FCD450 square bar

Cutting speed: 250 rn/min

Feed rate: 0.25 mm/rev

Depth of cut: 2 mm

Cutting time: 5 min

Coolant: Dry

For coated carbide cutting inserts of the present invention 13, 14 and conventional coated carbide cutting inserts 13, 14, following cutting tests were conducted:

(2-2) Cutting style: Interrupted turning of Alloy steel

Work piece: JIS SCM415 square bar

Cutting speed: 250 m/min

Feed rate: 0.25 mm/rev

Depth of cut: 2 mm

Cutting time: 5 min

Coolant: Dry

For coated carbide cutting inserts of the present invention 15, 16 and conventional coated carbide cutting inserts 15, 16, following cutting tests were conducted:

(2-3) Cutting style: Interrupted turning of Carbon steel

Work piece: JIS S45C square bar

Cutting speed: 250 m/min

Feed rate: 0.25 mm/rev

Depth of cut: 2 mm

Cutting time: 5 min

Coolant: Dry

For coated carbide cutting inserts of the present invention 17, 18 and conventional coated carbide cutting inserts 17, 18, following cutting tests were conducted:

(2-4) Cutting style: Interrupted turning of Cast iron

Work piece: JIS FC200 square bar

Cutting speed: 250 m/min

Feed rate: 0.25 mm/rev

Depth of cut: 2 mm

Cutting time: 5 min

Coolant: Dry

For coated carbide cutting inserts of the present invention 19, 20 and conventional coated carbide cutting inserts 19, 20, following cutting tests were conducted:

(2-5) Cutting style: Milling of Alloy steel

Work piece: JIS SCM440 square bar (100 mm width×500 mm length)

Cutting tool configuration: single cutting insert mounted with a cutter of 125 mm diameter Cutting speed: 250 m/min Feed rate: 0.2 mm/tooth Depth of cut: 2 mm Cutting time: 8.6 min Coolant: Dry Results are shown in Table 9.

Example 3

The same carbide substrate A as in EXAMPLE 1 was prepared. The surfaces of the carbide substrate A were subjected to honing and chemical vapor deposition using conventional equipment under the conditions shown in Table 10 to form hard coating layers that had a composition and a designed thickness (at the flank of the cutting insert) shown in Table 11. Coated carbide cutting inserts in accordance with the present invention 21 through 29 and conventional coated carbide cutting insert 21 were produced in such a manner.

Intervening layers comprising mainly $Ti_2O_3$ of the cutting inserts of present invention 21 through 29 and a cubic-type TiCNO layer of the cutting insert of conventional invention 21 were subjected to elemental analysis using an EPMA (electron probe micro analyzer) or AES (auger electron spectroscopy). The cutting insert used in the elemental analysis was identical to the one used in the cutting test. The elemental analysis was carried out by irradiating an electron beam having a diameter of 1 $\mu$m onto the center of the flank face. These layers were also subjected to X-ray diffraction analysis using Cu k$\alpha$-ray. Analytical results using a ratio of carbon plus nitrogen in each layer, (C+N)/(Ti+O+C+N), were shown in Table 12.

Further, continuous cutting tests were conducted for above cutting inserts under the following conditions: A wear width on a flank face was measured in each tests.

For coated carbide cutting inserts of the present invention 21 through 29 and conventional coated carbide cutting insert 21, following cutting tests were conducted:

(3-1) Cutting style: Continuous turning of alloy steel

Work piece: JIS SNCM439 round bar

Cutting speed: 280 m/min

Feed rate: 0.35 mm/rev

Depth of cut: 1.0 mm

Cutting time: 10 min

Coolant: Dry

Results are shown in Table 12.

Example 4

The same carbide substrate A as in EXAMPLE 1 was prepared. The surface of the carbide substrate A was subjected to honing and chemical vapor deposition using conventional equipment under the conditions shown in Table 13 to form hard coating layers that had a composition and a designed thickness (at the flank of the cutting insert) shown in Table 14. Coated carbide cutting inserts in accordance with the present invention 30 through 34 and conventional coated carbide cutting inserts 22 through 26 were produced in such a manner.

Further, continuous cutting tests and interrupted cutting tests were conducted for the above cutting inserts under the following conditions. A wear width on a flank face was measured in each tests.

For coated carbide cutting inserts of the present invention 30 through 34 and conventional coated carbide cutting inserts 22 through 26, following cutting tests were conducted:

(4-1) Cutting style: Continuous turning of carbon steel

Work piece: JIS S45C round bar

Cutting speed: 450 m/min

Feed rate: 0.3 mm/rev

Depth of cut: 3 mm

Cutting time: 10 min

Coolant: Dry (4-2) Cutting style: Interrupted turning of carbon steel

Work piece: JIS S45C square bar

Cutting speed: 200 m/min

Feed rate: 0.3 mm/rev

Depth of cut: 3 mm

Cutting time: 5 min

Coolant: Dry

Results are shown in Table 15.

Example 5

A cemented carbide cutting tool member of the present invention is coated with the following series of layers to form a hard coating layer:

| | | |
|---|---|---|
| 6th layer | TiN | 0.3 microns thick |
| 5th layer | $Al_2O_3$ | 3 microns thick |
| 4th layer | TiC | 1 micron thick |
| 3rd layer | $Al_2O_3$ | 10 microns thick |
| 2nd layer | Mostly $Ti_2O_3$ | 1 micron thick |
| 1st layer | TiCN | 5 microns thick |
| Substrate | Cemented Carbide | |

TABLE 1

| Carbide | Composition (wt %) | | | | | Vacuum sintering conditions | | | Rockwell hardness |
|---|---|---|---|---|---|---|---|---|---|
| substrate | Co | (Ti, W) C | (Ti, W) CN | (Ta, Nb) C | WC | Vacuum (torr) | Temperature (° C.) | Time (hr) | (Scale A) (HRA) |
| A | 6.3 | — | 6 | 4.1 | Balance | 0.10 | 1380 | 1 | 90.3 |
| B | 5.3 | 5.2 | — | 5.1 | Balance | 0.05 | 1450 | 1 | 90.9 |
| C | 9.5 | 8.1 | — | 4.9 | Balance | 0.05 | 1380 | 1.5 | 89.9 |
| D | 4.5 | — | 4.8 | 3.1 | Balance | 0.10 | 1410 | 1 | 91.4 |
| E | 10.2 | — | — | 2.2 | Balance (Coarse) | 0.05 | 1380 | 1 | 89.7 |

TABLE 2

| | Conditions for forming hard coating layer | | |
|---|---|---|---|
| | | Ambience | |
| Hard coating layer | Composition of reactive gas (volume %) | Pressure (torr) | Temperature (° C.) |
| Al2O3 | AlCl3: 2.2%, CO2: 5.5%, HCl: 2.2%, H2: Balance | 50 | 1000 |
| TiC | TiCl4: 4.2%, CH4: 4.5%, H2: Balance | 50 | 1020 |
| TiN | TiCl4: 4.2%, N2: 30%, H2: Balance | 200 | 1020 |
| TiCN | TiCl4: 4.2%, CH4: 4%, N2: 20%, H2: Balance | 50 | 1020 |
| TiCN* | TiCl4: 4.2%, CH3CN: 0.6%, N2: 20%, H2: Balance | 50 | 910 |
| TiCO | TiCl4: 2%, CO: 6%, H2: Balance | 50 | 980 |
| TiNO | TiCl4: 2%, NO: 6%, H2: Balance | 50 | 980 |
| TiCNO | TiCl4: 2%, CO: 3%, N2: 30%, H2: Balance | 50 | 980 |
| Ti2O3** | TiCl4: 2.5%, CO2: 3.5%, N2: 43.5%, H2: Balance | 200 | 1000 |

*TiCN layer having a crystal morphology longitudinally grown

**intervening layer comprising mainly corundum titanium oxide

TABLE 3

| Insert | | Substrate | Hard coating layer (FIG. in parenthses means designed thickness; μm) | | | | | |
|---|---|---|---|---|---|---|---|---|
| | | | First layer | Second layer | Third layer | Fourth layer | Fifth layer | Sixth layer |
| Conventional | 1 | A | TiN (0.1) | TiCN* (5) | Al2O3 (3) | TiN (0.2) | | |
| | 2 | B | TiC (0.5) | TiN (1) | TiCN* (4) | Al2O3 (4) | | |
| | 3 | C | TiN (0.1) | TiCN* (3) | TiCO (0.1) | Al2O3 (4) | TiN (0.1) | |
| | 4 | D | TiN (0.1) | TiCN* (3) | TiCNO (0.1) | Al2O3 (4.5) | | |
| | 5 | A | TiCN (3) | TiCN* (6) | TiN (2.5) | Al2O3 (2) | | |
| | 6 | B | TiC (1) | TiCN* (5) | TiNO (0.1) | TiCNO (0.3) | Al2O3 (4) | |
| | 7 | C | TiN (0.5) | TiCN (5) | Al2O3 (4) | TiN (0.3) | | |
| | 8 | D | TiC (3) | Al2O3 (2) | | | | |
| | 9 | A | TiN (1) | Al2O3 (3) | TiCN* (4) | Al2O3 (4) | | |
| | 10 | E | TiN (0.1) | TiCN* (5) | TiC (3) | TiNO (0.1) | Al2O3 (3) | TiN (0.1)tz,1/57 |

*TiCN layer having a crystal morphology longitudinally grown

TABLE 5

| Insert | | Flank wear (mm) | | | Insert | | Flank wear (mm) | | |
|---|---|---|---|---|---|---|---|---|---|
| | | (1-1) | (1-2) | (1-3) | | | (1-1) | (1-2) | (1-3) |
| This invention | 1 | 0.25 | 0.19 | — | Conventional | 1 | 0.29 | Failure at 1.0 min | — |
| | 2 | 0.22 | 0.17 | — | | 2 | 0.28 | Failure at 0.5 min | — |
| | 3 | 0.30 | 0.18 | — | | 3 | 0.30 | Failure at 3.5 min | — |
| | 4 | 0.24 | 0.19 | — | | 4 | 0.25 | Failure at 1.0 min | — |
| | 5 | 0.29 | 0.20 | — | | 5 | 0.29 | Failure at 1.0 min | — |
| | 6 | 0.21 | 0.20 | — | | 6 | 0.25 | Failure at 1.0 min | — |
| | 7 | 0.29 | 0.21 | — | | 7 | 0.31 | Failure at 0.5 min | — |
| | 8 | 0.21 | 0.20 | — | | 8 | 0.24 | Failure at 0.5 min | — |
| | 9 | 0.22 | 0.18 | — | | 9 | 0.30 | Failure at 2.0 min | — |
| | 10 | — | — | 0.20 | | 10 | — | — | Failure at 4.0 min |

Remark: Failure is caused by chipping

TABLE 6

| Hard coating layer | Conditions for forming hard coating layer | | |
|---|---|---|---|
| | Composition of reactive gas (volume %) | Ambience | |
| | | Pressure (torr) | Temperature (° C.) |
| TiC | TiCl4: 4%, CH4: 9%, H2: Balance | 50 | 1020 |
| TiN (first layer) | TiCl4: 4%, N2: 30%, H2: Balance | 50 | 920 |
| TiN (the other layer) | TiCl4: 4%, N2: 35%, H2: Balance | 200 | 1020 |
| TiCN* | TiCl4: 4%, CH3CN: 1.2%, N2: 30%, H2: Balance | 50 | 900 |
| TiCN | TiCl4: 4%, CH4: 4%, N2: 30%, H2: Balance | 50 | 1020 |
| TiCO | TiCl4: 4%, CO: 9%, H2: Balance | 50 | 1020 |
| TiNO | TiCl4: 4%, NO: 9%, H2: Balance | 50 | 1020 |
| TiCNO | TiCl4: 4%, CO: 5%, N2: 8%, H2: Balance | 50 | 1020 |
| Ti2O3** | TiCl4: 2.5%, CO2: 3.5%, N2: 43.5%, H2: Balance | 80 | 1020 |
| Al2O3 (a) | AlCl3: 2.2%, CO2: 5.5%, HCl: 2:2%, H2: Balance | 50 | 1030 |
| Al2O3 (b) | AlCl3: 2.2%, CO2: 5.5%, HCl: 2.2%, H2: Balance | 50 | 970 |

*TiCN layer having a crystal morphology longitudinally grown
**intervening layer comprising mainly corundum titanium oxide

TABLE 7

| Insert | | Substrate | Hard coating layer (FIG. in parenthses means designed thickness; μm) | | | | | | |
|---|---|---|---|---|---|---|---|---|---|
| | | | cubic-Ti compound layer | | | Composit layer | | | Outermost |
| | | | First layer | Second layer | Third layer | Initial layer | Medium layer | Final layer | layer |
| This invention | 11 | A | TiN (0.5) | TiCN* (9) | TiCO (0.3) | Al2O3 (b) (1.5) | Ti2O3** (0.1) | Al2O3 (b) (1.5) | TiN (0.5) |
| | 12 | A | TiN (0.5) | TiCN* (5) | TiCN (2) | Al2O3 (a) (1) | Ti2O3** (0.1): 3 layers<br>Al2O3 (a) (2): 2 layers | Al2O3 (a) (1) | — |
| | 13 | B | TiC (2) | TiCO (1) | TiCN* (5) | Al2O3 (a) (1) | Ti2O3** (0.2): 10 layers<br>Al2O3 (a) (2): 9 layers | Al2O3 (a) (1) | TiN (0.5) |
| | 14 | B | TiC (5) | — | — | Al2O3 (a) (1) | Ti2O3** (0.1): 3 layers<br>Al2O3 (a) (1.5): layers | Al2O3 (a) (1) | — |
| | 15 | C | TiCN (3) | TiCN* (3) | TiCNO (0.5) | Al2O3 (b) (2) | Ti2O3** (0.3): 2 layers<br>Al2O3 (b) (2): 1 layer | Al2O3 (b) (2) | — |
| | 16 | C | TiN (2) | TiCN* (5) | — | Al2O3 (a) (3) | Ti2O3** (0.2): 2 layers<br>Al2O3 (b) (3): 1 layer | Al2O3 (a) (3) | — |
| | 17 | D | TiN (1) | TiCN* (5) | TiCO (0.3) | Al2O3 (a) (7) | Ti2O3** (0.3) | Al2O3 (a) (7) | TiN (1) |
| | 18 | D | TiN (1) | TiCN* (5) | TiNO (0.5) | Al2O3 (a) (0.5) | Ti2O3** (0.1): 15 layers<br>Al2O3 (a) (1): 14 layer | Al2O3 (a) (0.5) | TiN (1) |
| | 19 | E | TiC (2) | — | — | Al2O3 (a) (0.5) | Ti2O3** (0.05): 2 layers<br>Al2O3 (a) (0.5): 1 layer | Al2O3 (a) (0.5) | — |
| | 20 | E | TiCN (3) | — | — | Al2O3 (b) (1.5) | Ti2O3** (0.1) | Al2O3 (b) (1.5) | — |

*TiCN layer having a crystal morphology longitudinally grown
**intervening layer comprising mainly corundum titanium oxide

TABLE 8

| Insert | | Substrate | Hard coating layer (FIG. in parenthses means designed thickness; μm) | | | | |
|---|---|---|---|---|---|---|---|
| | | | First layer | Second layer | Third layer | Fourth layer | Fifth layer |
| Conventional | 11 | A | TiN (0.5) | TiCN* (9) | TiCO (0.3) | Al2O3 (b) (3) | TiN (0.5) |
| | 12 | A | TiN (0.5) | TiCN* (5) | TiCN (2) | Al2O3 (a) (6) | — |
| | 13 | B | TiC (2) | TiCO (1) | TiCN* (5) | Al2O3 (a) (5) | TiN (0.5) |
| | 14 | B | TiC (5) | Al2O3 (a) (7) | — | — | — |
| | 15 | C | TiCN (3) | TiCN* (3) | TiCNO (0.5) | Al2O3 (b) (8) | — |
| | 16 | C | TiN (2) | TiCN* (5) | Al2O3 (a) (2) | TiN (1) | — |
| | 17 | D | TiN (1) | TiCN* (5) | TiCO (0.3) | Al2O3 (a) (14) | TiN (1) |
| | 18 | D | TiN (1) | TiCN* (5) | TiNO (0.5) | Al2O3 (a) (15) | TiN (1) |
| | 19 | E | TiC (2) | Al2O3 (a) (2) | — | — | — |
| | 20 | E | TiCN (3) | Al2O3 (b) (3) | TiN (0.3) | — | — |

*TiCN layer having a crystal morphology longitudinally grown

TABLE 9

| Insert | | Flank wear (mm) | Insert | | Flank wear (mm) |
|---|---|---|---|---|---|
| This invention | 11 | 0.17 | Conventional | 11 | Failure at 0.9 min |
| | 12 | 0.18 | | 12 | Failure at 1.4 min |
| | 13 | 0.21 | | 13 | Failure at 2.1 min |
| | 14 | 0.20 | | 14 | Failure at 2.5 min |
| | 15 | 0.18 | | 15 | Failure at 1.1 min |
| | 16 | 0.18 | | 16 | Failure at 2.3 min |
| | 17 | 0.17 | | 17 | Failure at 2.5 min |
| | 18 | 0.15 | | 18 | Failure at 1.6 min |
| | 19 | 0.21 | | 19 | Failure at 3.3 min |
| | 20 | 0.22 | | 20 | Failure at 1.6 min |

Remark: Failure is caused by chipping

TABLE 10

| Hard coating layer | Conditions for forming hard coating layer: Composition of reactive gas (volume %) | Ambience: Pressure (torr) | Ambience: Temperature (° C.) |
|---|---|---|---|
| TiN (first layer) | TiCl4: 4%, N2: 30%, H2: Balance | 50 | 920 |
| TiN (the other layer) | TiCl4: 4%, N2: 35%, H2: Balance | 200 | 1020 |
| TiCN* | TiCl4: 4%, CH3CN: 1.2%, N2: 30%, H2: Balance | 50 | 900 |
| TiCNO | TiCl4: 4%, CO: 5%, N2: 8%, H2: Balance | 50 | 1020 |
| Ti2O3** (a) | TiCl4: 2.5%, CO2: 3.5%, N2: 30%, Ar: 40%, H2: Balance | 200 | 1030 |
| Ti2O3** (b) | TiCl4: 2.5%, CO2: 3.5%, N2: 20%, Ar: 30%, H2: Balance | 200 | 1030 |
| Ti2O3** (c) | TiCl4: 2.5%, CO2: 3.5%, N2: 20%, Ar: 20%, H2: Balance | 200 | 1030 |
| Ti2O3** (d) | TiCl4: 2.5%, CO2: 3.5%, N2: 20%, Ar: 10%, H2: Balance | 200 | 1030 |
| Al2O3** (e) | TiCl4: 2.5%, CO2: 3.5%, N2: 10%, Ar: 5%, H2: Balance | 200 | 1030 |
| Al2O3** (f) | TiCl4: 2.5%, CO2: 3.5%, N2: 10%, Ar: 0%, H2: Balance | 200 | 1030 |
| Ti2O3** (g) | TiCl4: 2.5%, CO2: 3.5%, N2: 10%, Ar: 5%, H2: Balance | 50 | 900 |
| Ti2O3** (h) | TiCl4: 2.5%, CO2: 3.5%, N2: 5%, Ar: 5%, H2: Balance | 100 | 950 |
| Ti2O3** (i) | TiCl4: 2.5%, CO2: 2.0%, N2: 5%, Ar: 0%, H2: Balance | 250 | 1030 |
| Al2O3 | AlCl3: 2.2%, CO2: 5.5%, HCl: 2.2%, H2: Balance | 50 | 1030 |

*TiCN layer having a crystal morphology longitudinally grown
**intervening layer comprising mainly corundum titanium oxide

TABLE 11

| Insert | | Hard coating layer (FIG. in parenthes means designed thickness; μm): 1st layer | 2nd layer | 3rd layer | 4th layer | 5th layer |
|---|---|---|---|---|---|---|
| This invention | 21 | TiN (1) | TiCN* (6) | Ti2O3** (a) (1) | Al2O3 (7) | TiN (0.3) |
| | 22 | TiN (1) | TiCN* (6) | Ti2O3** (b) (1) | Al2O3 (7) | TiN (0.3) |
| | 23 | TiN (1) | TiCN* (6) | Ti2O3** (c) (1) | Al2O3 (7) | TiN (0.3) |
| | 24 | TiN (1) | TiCN* (6) | Ti2O3** (d) (1) | Al2O3 (7) | TiN (0.3) |
| | 25 | TiN (1) | TiCN* (6) | Ti2O3** (e) (1) | Al2O3 (7) | TiN (0.3) |
| | 26 | TiN (1) | TiCN* (6) | Ti2O3** (f) (1) | Al2O3 (7) | TiN (0.3) |
| | 27 | TiN (1) | TiCN* (6) | Ti2O3** (g) (1) | Al2O3 (7) | TiN (0.3) |
| | 28 | TiN (1) | TiCN* (6) | Ti2O3** (h) (1) | Al2O3 (7) | TiN (0.3) |
| | 29 | TiN (1) | TiCN* (6) | Ti2O3** (1) (1) | Al2O3 (7) | TiN (0.3) |
| Conventional | 21 | TiN (1) | TiCN* (6) | TiCNO (1) | Al2O3 (7) | TiN (0.3) |

*TiCN layer having a crystal morphology longitudinally grown
**intervening layer comprising mainly corundum titanium oxide

TABLE 12

| Insert | | Analytical data: (C + N)/(Ti + O + C + N) | Position of maximum peak in XRD pattern of Ti2O3 layer | Flank wear (mm) |
|---|---|---|---|---|
| This invention | 21 | 0% | 2θ = 34.5° | 0.43 |
| | 22 | 0.7% | 2θ = 34.5° | 0.29 |
| | 23 | 2.4% | 2θ = 34.5° | 0.24 |
| | 24 | 4.6% | 2θ = 34.5° | 0.31 |
| | 25 | 8.1% | 2θ = 34.5° | 0.38 |
| | 26 | 14.1% | 2θ = 34.5° | 0.42 |
| | 27 | 1.8% | 2θ = 54.0° | 0.40 |
| | 28 | 3.2% | 2θ = 24.1° | 0.44 |
| | 29 | 17.6% | 2θ = 54.0° | 0.50 |
| Conventional | 21 | 32.2% | — | 0.68 |

TABLE 13

| Hard coating layer | Conditions for forming hard coating layer: Composition of reactive gas (volume %) | Ambience: Pressure (torr) | Ambience: Temperature (° C.) |
|---|---|---|---|
| TiC | TiCl4: 4%, CH4: 9%, H2: Balance | 50 | 1020 |
| TiN | TiCl4: 4%, N2: 35%, H2: Balance | 200 | 1020 |
| TiCN | TiCl4: 4%, CH4: 4%, N2: 30%, H2: Balance | 50 | 1020 |
| TiCN* | TiCl4: 4%, CH3CN: 1.2%, N2: 30%, H2: Balance | 50 | 900 |
| TiCO | TiCl4: 4%, CO: 4%, H2: Balance | 50 | 1020 |
| TiNO | TiCl4: 4%, NO: 6%, H2: Balance | 50 | 1020 |
| TiCNO | TiCl4: 4%, CO: 3%, N2: 30%, H2: Balance | 50 | 1020 |
| Ti2O3** | TiCl4: 3%, CO2: 3%, N2: 30%, H2: Balance | 100 | 1020 |
| Al2O3 | AlCl3: 2.2%, CO2: 5.5%, HCl: 2.2%, H2: Balance | 50 | 1020 |

*TiCN layer having a crystal morphology longitudinally grown
**intervening layer comprising mainly corundum titanium oxide

TABLE 14

| Insert | | Hard coating layer (FIG. in parenthses means designed thickness; μm): First layer | Second layer | Third layer | Fourth layer | Fifth layer | Sixth layer | Seventh layer | Eighth layer | Nineth layer | Tenth layer |
|---|---|---|---|---|---|---|---|---|---|---|---|
| This invention | 30 | TiN (0.5) | TiCN* (6) | Ti2O3** (0.8) | Al2O3 (5) | Ti2O3** (0.2) | Al2O3 (4) | TiN (0.3) | | | |
| | 31 | TiN (0.3) | TiCN* (5) | TiC (3) | Ti2O3** (0.5) | Al2O3 (4) | Ti2O3** (0.2) | Al2O3 (4) | Ti2O3** (0.2) | Al2O3 (4) | TiN (0.3) |
| | 32 | TiCN (5) | Ti2O3** (0.5) | Al2O3 (4) | T2O3** (0.1) | Al2O3 (3) | Ti2O3** (0.1) | Al2O3 (3) | | | |
| | 33 | TiC (6) | Ti2O3** (0.8) | Al2O3 (5) | Ti2O3** (0.2) | Al2O3 (5) | Ti2O3** (0.2) | Al2O3 (5) | TiN (0.3) | | |
| | 34 | TiN (0.5) | TiCN* (5) | Ti2O3** (0.5) | Al2O3 (3) | Ti2O3** (0.2) | Al2O3 (3) | Ti2O3** (0.2) | Al2O3 (3) | TiN (0.3) | |
| Conventional | 22 | TiN (0.5) | TiCN* (6) | TiCNO (0.4) | Al2O3 (9) | TiN (0.3) | | | | | |
| | 23 | TiN (0.3) | TiCN* (5) | TiC (3) | TiN (0.5) | Al2O3 (12) | TiN (0.3) | | | | |
| | 24 | TiCN (5) | TiCO (0.5) | Al2O3 (10) | | | | | | | |
| | 25 | TiC (6) | TiNO (0.4) | Al2O3 (15) | TiN (0.3) | | | | | | |
| | 26 | TiN (0.5) | TiCN* (5) | TiCO (0.4) | Al2O3 (3) | TiN (0.2) | Al2O3 (3) | TiN (0.2) | Al2O3 (3) | TiN (0.3) | |

*TiCN layer having a crystal morphology longitudinally grown
**intervening layer comprising mainly corundum titanium oxide

TABLE 15

| Insert | | Flank wear (mm) (4-1) | Flank wear (mm) (4-2) | Insert | | Flank wear (mm) (4-1) | Flank wear (mm) (4-2) |
|---|---|---|---|---|---|---|---|
| This invention | 30 | 0.31 | 0.25 | Conventional | 22 | 0.36 | Failure at 2.3 min |
| | 31 | 0.32 | 0.24 | | 23 | 0.33 | Failure at 1.5 min |
| | 32 | 0.29 | 0.28 | | 24 | 0.49 | Failure at 1.1 min |
| | 33 | 0.30 | 0.25 | | 25 | 0.57 | Failure at 1.3 min |
| | 34 | 0.33 | 0.24 | | 26 | 0.33 | Failure at 3.8 min |

Remark: Failure is caused by chipping

The present application is based on Japanese Priority Applications JP 09-120704, filed on May 12, 1997, JP 09-238198, filed on Sep. 3, 1997, and JP 09-318100, filed on Nov. 19, 1997, the entire contents of which are hereby incorporated by reference.

What is claimed is:

1. A coated carbide cutting tool member comprising:

a substrate; and a hard coating layer on said substrate, wherein said hard coating layer comprises at least one layer comprising a titanium compound having a cubic lattice structure, at least one layer comprising aluminum oxide, and at least one intervening layer, wherein said intervening layer is between said layer comprising said titanium compound having a cubic lattice structure and said aluminum oxide layer, or between said aluminum oxide layers, and said intervening layer comprises titanium oxide having a corundum lattice structure.

2. The article of claim 1, wherein said substrate comprises tungsten carbide.

3. The article of claim 1, wherein said at least one layer comprising said titanium compound having a cubic lattice structure comprises at least one layer selected from the group consisting of titanium carbide, titanium nitride, titanium carbonitride, titanium carboxide, titanium nitroxide, and titanium carbonitroxide.

4. The article of claim 1, wherein said intervening layer has a thickness of 0.1 to 5 $\mu$m.

5. The article of claim 1, wherein said intervening layer has a thickness of 0.05 to 2 $\mu$m.

6. The article of claim 1, wherein said hard coating layer has a thickness of 3 to 25 $\mu$m.

7. The article of claim 1, wherein each of said aluminum oxide layers has a thickness of 0.5 to 10 $\mu$m.

8. The article according to claim 1, wherein said intervening layer comprising titanium oxide having a corundum lattice structure shows a maximum peak intensity at 2 $\theta$=34.5±1° in a X-ray diffraction pattern using a Cu k$\alpha$-ray.

9. The article according to claim 8, wherein said intervening layer further comprises titanium carbonitroxide in a cubic lattice structure.

10. The article according to claim 9, wherein an atomic ratio of carbon, nitrogen, oxygen and titanium in said intervening layer is expressed as follows:

$$0\% \leqq (C+N)/(Ti+O+C+N) \leqq 10\%.$$

11. The article according to claim 10, wherein said atomic ratio is:

$$0.5\% \leqq (C+N)/(Ti+O+C+N) \leqq 5\%.$$

12. The article according to claim 1, wherein said intervening layer further comprises titanium carbonitroxide in a cubic lattice structure.

13. The article according to claim 9, wherein an atomic ratio of carbon, nitrogen, oxygen and titanium in said intervening layer is expressed as follows:

$$0\% \leqq (C+N)/(Ti+O+C+N) \leqq 10\%.$$

14. The article according to claim 13, wherein said atomic ratio is:

$$0.5\% \leqq (C+N)/(Ti+O+C+N) \leqq 5\%.$$

15. The article according to claim 1, wherein an atomic ratio of carbon, nitrogen, oxygen and titanium in said intervening layer is expressed as follows:

$$0\% \leqq (C+N)/(Ti+O+C+N) \leqq 10\%.$$

16. The article according to claim 15, wherein said atomic ratio is:

$$0.5\% \leqq (C+N)/(Ti+O+C+N) \leqq 5\%.$$

17. The article according to claim 1, wherein said intervening layer is in contact with both of said layer comprising said titanium compound having a cubic lattice structure, and said aluminum oxide layer.

18. A coated carbide cutting tool member comprising:

a substrate comprising tungsten carbide; and a hard coating layer on said substrate having a thickness of 3 to 25 $\mu$m, wherein said hard coating layer comprises at least one layer comprising a titanium compound having a cubic lattice structure, at least two layers comprising aluminum oxide, and at least one intervening layer, wherein said intervening layer is between said layer comprising said titanium compound having a cubic lattice structure and said aluminum oxide layer or between said aluminum oxide layers, and said intervening layer comprises titanium oxide having a corundum lattice structure.

19. The article of claim 18, wherein said at least one layer comprising said titanium compound having a cubic lattice structure comprises at least one layer selected from the group consisting of titanium carbide, titanium nitride, titanium carbonitride, titanium carboxide, titanium nitroxide, and titanium carbonitroxide.

20. The article according to claim 18, wherein each of said aluminum oxide layers has a thickness of 0.5 to 10 $\mu$m.

21. The article of claim 18, wherein said intervening layer has a thickness of 0.05 to 2 $\mu$m.

22. The article according to claim 18, wherein said intervening layer comprising titanium oxide having a corundum lattice structure shows a maximum peak intensity at 2 $\theta$=34.5±1 in a X-ray diffraction pattern using a Cu k$\alpha$-ray.

23. The article according to claim 18, wherein said intervening layer further comprises titanium carbonitroxide in a cubic lattice structure.

24. The article according to claim 22, wherein said intervening layer further comprises titanium carbonitroxide in a cubic lattice structure.

* * * * *